US009119489B2

(12) United States Patent
Buettner et al.

(10) Patent No.: US 9,119,489 B2
(45) Date of Patent: Sep. 1, 2015

(54) SEASONAL FEATURE DISPLAYER

(75) Inventors: Megan Buettner, Avon, OH (US); Anthony Santarelli, North Olmsted, OH (US); Emory Brozak, Strongsville, OH (US)

(73) Assignee: American Greetings Corporation, Cleveland, OH (US)

( * ) Notice: Subject to any disclaimer, the term of this patent is extended or adjusted under 35 U.S.C. 154(b) by 189 days.

(21) Appl. No.: 13/527,647

(22) Filed: Jun. 20, 2012

(65) Prior Publication Data

US 2012/0318759 A1 Dec. 20, 2012

Related U.S. Application Data

(60) Provisional application No. 61/498,709, filed on Jun. 20, 2011.

(51) Int. Cl.
*A47F 7/14* (2006.01)
*A47F 5/00* (2006.01)

(52) U.S. Cl.
CPC ..... *A47F 7/145* (2013.01); *A47F 7/147* (2013.01); *A47F 5/0062* (2013.01)

(58) Field of Classification Search
CPC ..... A47F 5/0807; A47F 5/10; A47F 7/145; A47F 7/146; A47F 5/0062
USPC ..... 211/55, 5, 128.1; 40/122, 124.2, 605, 40/606.01, 606.03, 606.08, 606.12, 40/606.14; 108/61; 312/123
See application file for complete search history.

(56) References Cited

U.S. PATENT DOCUMENTS

| | | | | |
|---|---|---|---|---|
| 107,225 | A * | 9/1870 | Caflin | 182/103 |
| 457,598 | A * | 8/1891 | Briggs | 206/45.23 |
| 918,186 | A * | 4/1909 | Morse | 211/55 |
| 1,455,192 | A * | 5/1923 | Dumont | 40/124.2 |
| 1,594,754 | A * | 8/1926 | Reines | 108/61 |
| 2,067,051 | A * | 1/1937 | Hall | 211/55 |
| 2,333,717 | A * | 11/1943 | Heed et al. | 312/50 |
| 3,983,649 | A * | 10/1976 | Ellis et al. | 40/122 |
| 4,258,826 | A * | 3/1981 | Murray | 182/20 |
| 4,460,097 | A * | 7/1984 | Darnell et al. | 211/189 |
| 5,436,792 | A * | 7/1995 | Leman et al. | 361/679.44 |
| 6,098,818 | A * | 8/2000 | Ali et al. | 211/50 |
| 6,206,212 | B1 * | 3/2001 | Loew | 211/189 |
| 6,505,797 | B1 * | 1/2003 | Dempsey | 248/166 |
| 6,530,485 | B1 * | 3/2003 | Weber | 211/55 |
| 6,675,978 | B2 * | 1/2004 | Shea | 211/59.1 |
| 7,987,998 | B1 | 8/2011 | Belk et al. | |
| 8,172,093 | B1 | 5/2012 | Belk et al. | |
| 2009/0114481 | A1 | 5/2009 | Tejada et al. | |
| 2009/0151211 | A1 * | 6/2009 | Alyn | 40/605 |
| 2012/0012542 | A1 * | 1/2012 | Brown et al. | 211/26 |
| 2012/0205330 | A1 | 8/2012 | Belk et al. | |

* cited by examiner

*Primary Examiner* — Korie H Chan
(74) *Attorney, Agent, or Firm* — Christine Flanagan

(57) ABSTRACT

The seasonal feature displayer of the present disclosure and related inventions is configured to highlight and provide semi-permanent placement for a small selection of seasonal or special collection greeting cards among various other greeting cards displayed on a standard tiered greeting card fixture. The displayer utilizes two pivoting attachment support arms for attachment of the displayer to a tiered greeting card fixture. Integrated channels on the inside edges of the display are capable of holding product signage or marketing messages.

13 Claims, 7 Drawing Sheets

SEASONAL FEATURE DISPLAYER

RELATED APPLICATIONS

This application claims priority to U.S. Provisional Patent Application No. 61/498,709 filed on Jun. 20, 2011, a copy of which is incorporated herein by reference in its entirety.

FIELD OF THE INVENTION

This invention is in the general field of retail merchandise displays, and more specifically, to displays for highlighting seasonal consumer products such as greeting cards.

BACKGROUND OF THE INVENTION

Greeting cards for various occasions such as birthday, anniversary, wedding, etc. typically have a general location in which they are displayed among various greeting card display fixtures. Due to the large variety of greeting cards that are offered in each category, many times entire display fixtures are dedicated to cards specific to a particular occasion or event. However, some seasonal greeting cards or special product collections don't typically have a specific location or home among the categorized greeting cards on a conventional or generic greeting card fixture. The variety of seasonal or special collection greeting cards offered is much smaller in number than those in the general greeting card categories and as such, they don't have a specific location on such a display where consumers may readily locate them. These greeting cards may become lost or otherwise difficult to locate among the vast number of greeting cards offered on a single greeting card display.

SUMMARY OF THE INVENTION

The seasonal feature displayer of the present disclosure and related inventions is configured to highlight and provide semi-permanent placement for a small selection of seasonal or special collection greeting cards among various other greeting cards displayed on a standard tiered greeting card fixture. The displayer utilizes two pivoting attachment support arms for attachment of the displayer to a tiered greeting card fixture. Integrated channels on the inside edges of the display are capable of holding product signage or marketing messages.

DETAILED DESCRIPTION OF PREFERRED AND ALTERNATE EMBODIMENTS

The seasonal feature displayer 100 (also referred to herein as "displayer" or "feature displayer") of the present disclosure and related inventions provides a novel way to contain and display seasonal or special collection greeting cards within traditional tiered greeting card display fixtures. The displayer 100 can be easily added when there is a need to highlight or draw attention to a specific group of greeting cards and can be easily removed, when necessary. The seasonal feature displayer 100 may contain and display a plurality of greeting cards, signage such as advertisements, marketing messages, product descriptions or a combination thereof. The greeting cards contained on the displayer are arranged in a front-facing manner in a stacked and side-by-side arrangement, wherein typically identical greeting cards are contained in the same stack and different greeting card stacks are arranged in a side-by-side or adjacent manner. Divider clips may be used to segment each card row or tier into individual card pockets to separate different stacks of greeting cards.

Figure 2:
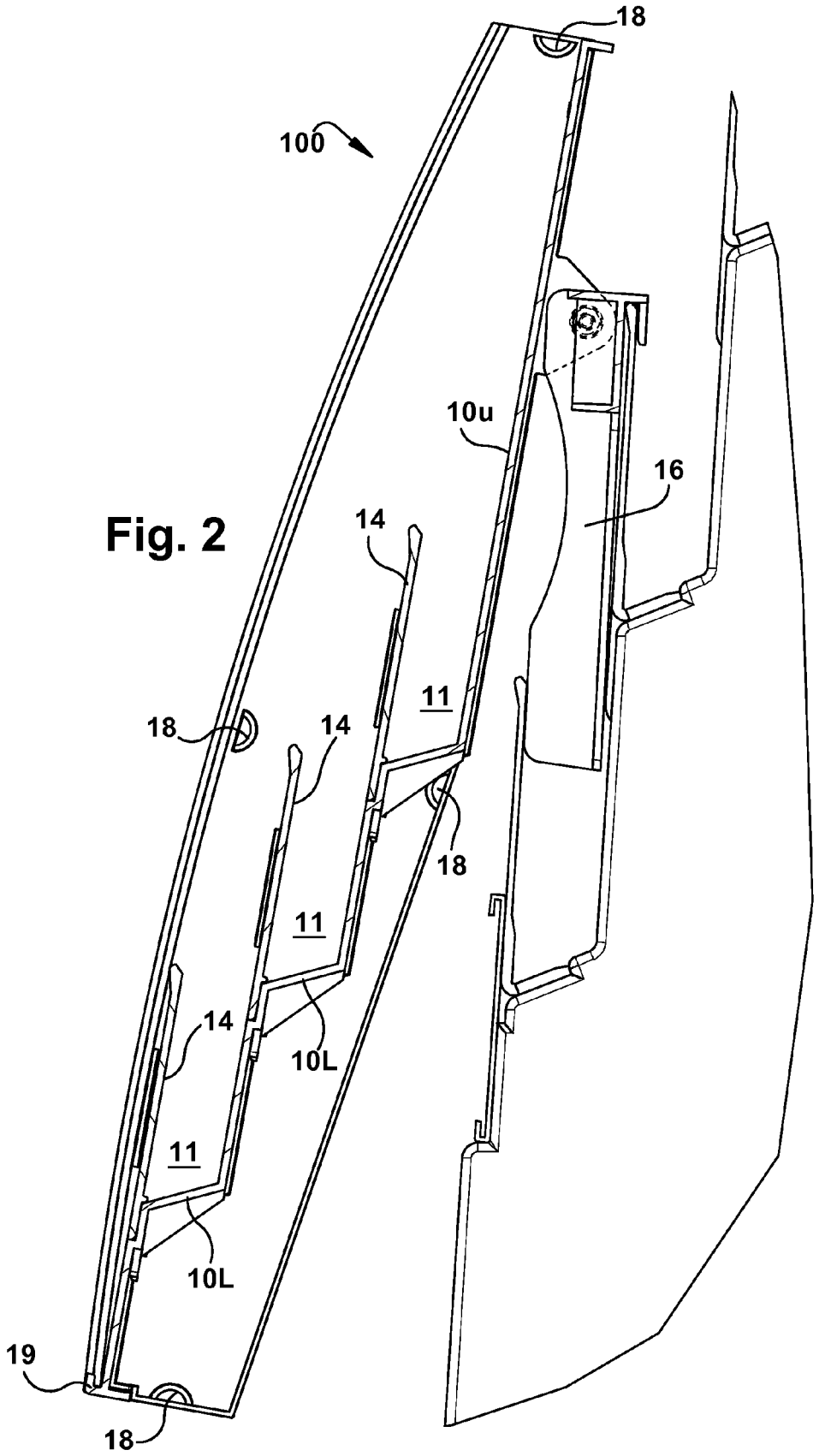
FIG. 2 is a cross-sectional view of the seasonal feature displayer of FIG. 1 from the direction of arrows 2-2.
Figure 6:
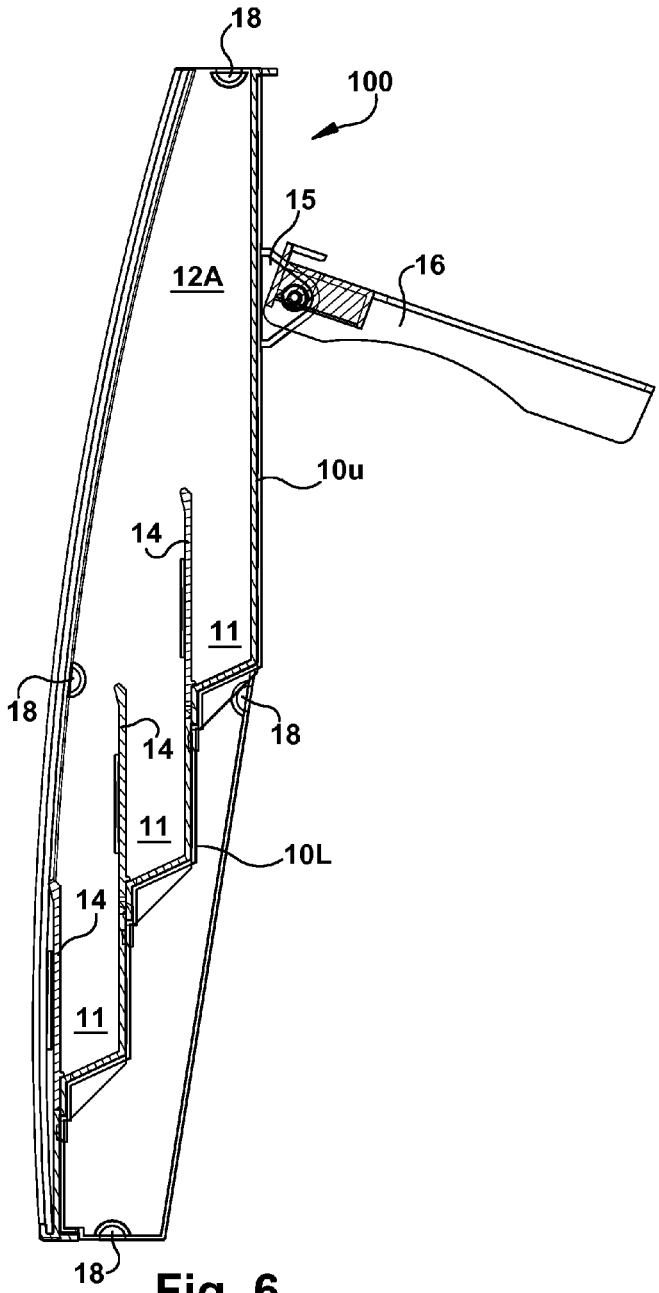
FIG. 6 is a cross-sectional view of the seasonal feature displayer of FIG. 4 from the direction of arrows 6-6.
Figure 7:
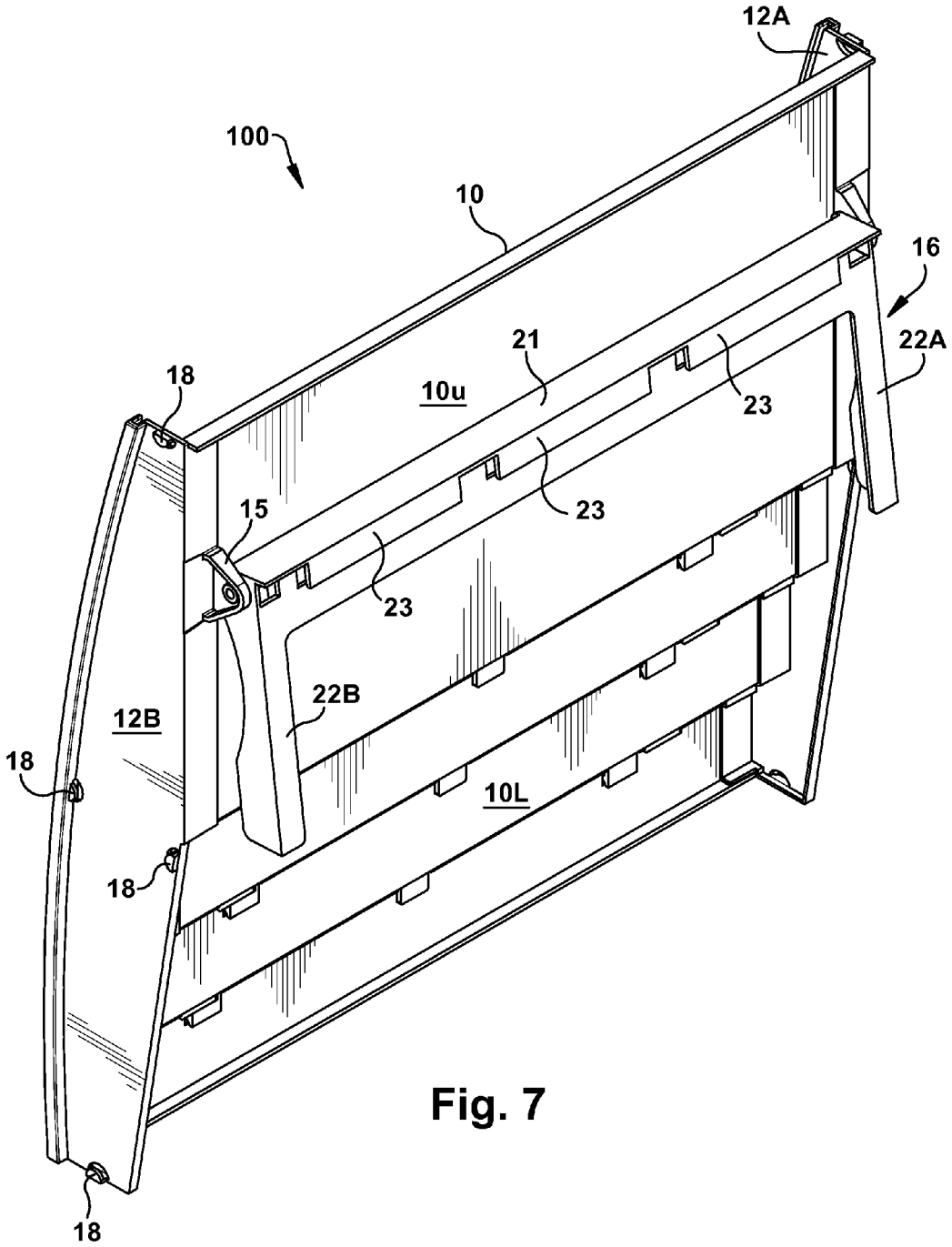
FIG. 7 is rear perspective view of the seasonal feature displayer of FIG. 1.
Figure 8:
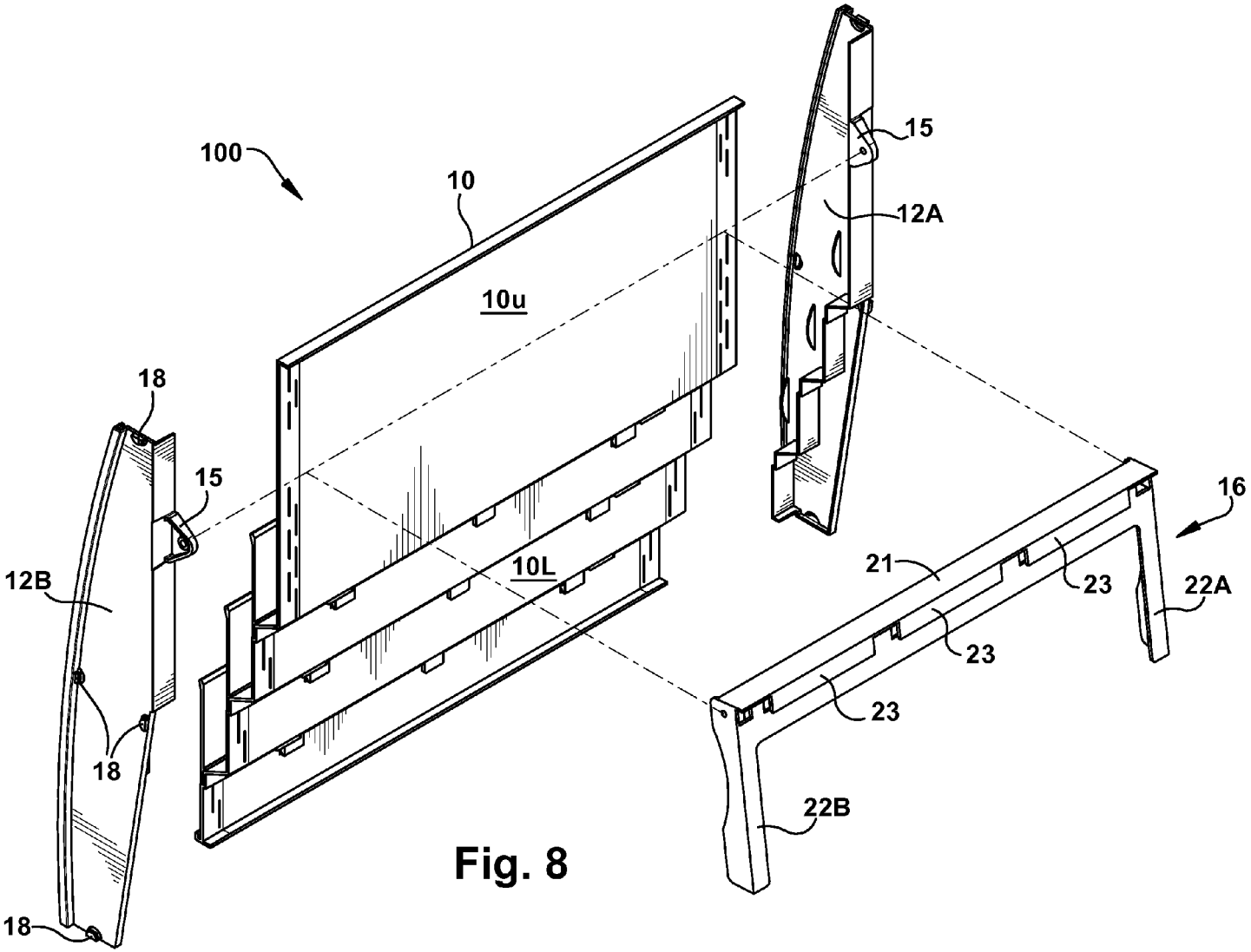
FIG. 8 is an exploded view of the seasonal feature displayer of FIG. 1.

Components of the seasonal feature displayer 100 may include, but are not limited to: a tray 10; a right side panel 12A; a left side panel 12B; two or more front pocket panels 14; and a tray hanger bracket 16. The tray 10, as shown in FIGS. 2 and 6, is the mainstay of the displayer 100 and serves as the complete backing (of the first pocket or pocket located at the highest elevation) or partial backing (of the other pockets) and the floor of the card pockets (created between the tray 10 and each front pocket panel 14). The tray 10 contains an upper section 10U which is a substantially planar panel which is connected to and integral with, a lower section 10L, which extends outward and away from the upper portion 10U in a stepped manner. Each step of the lower section 10L corresponds to a card row and contains a floor portion which is slightly angled in an outward and downward manner and a vertical portion which extends downward from the floor portion to connect to the next step or floor portion. The floor portions serve as the floor of the greeting card pockets, the pockets created between the tray 10 and the front pocket panels 14. The levels or steps of the lower portion 10L of the tray 10 each contain one or more spaced apart openings or apertures 11 thereon configured to accommodate attachment of a front pocket panel 14. The bottom edge of the tray 10 contains a small lip which creates a channel which serves to accommodate signage or other graphic inserts. In a preferred embodiment, the tray 10 is approximately 18-inches long and 18-inches wide, the width of each stepped portion or card pocket floor being approximately 1-inch wide. These dimensions are presented as an example and are intended to describe a preferred embodiment of the invention and are not meant to limit the application in any way. Various tray and card pocket dimensions have been contemplated and are considered to be within the scope of the present invention. Also, the tray has been shown in the figures as having three stepped portions or card rows, however, a fewer or greater number of card rows are considered to be within the scope of the invention.

Figure 1:
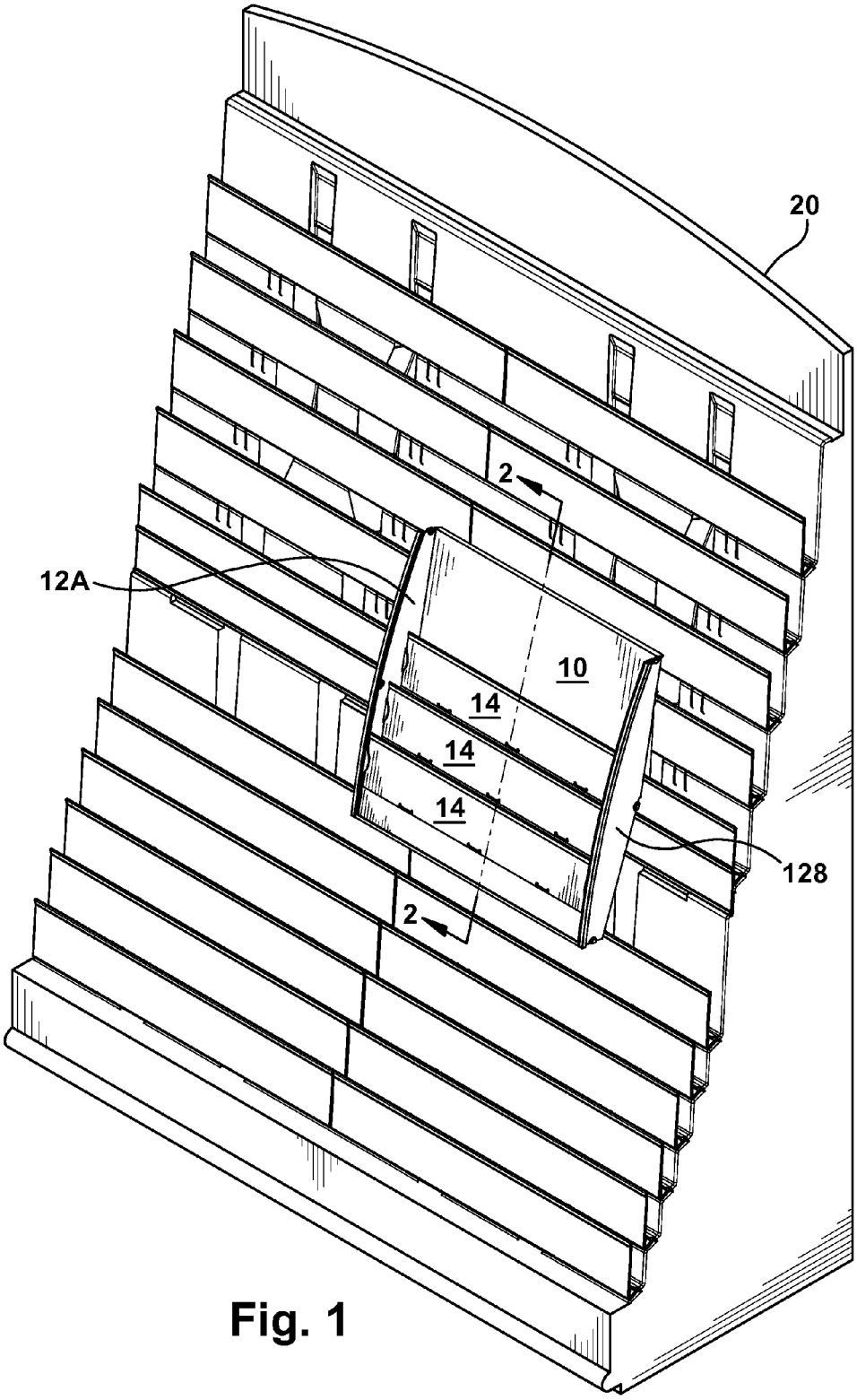
FIG. 1 is a front perspective view of a tiered greeting card fixture with attached seasonal feature displayer of the present invention.
Figure 3:
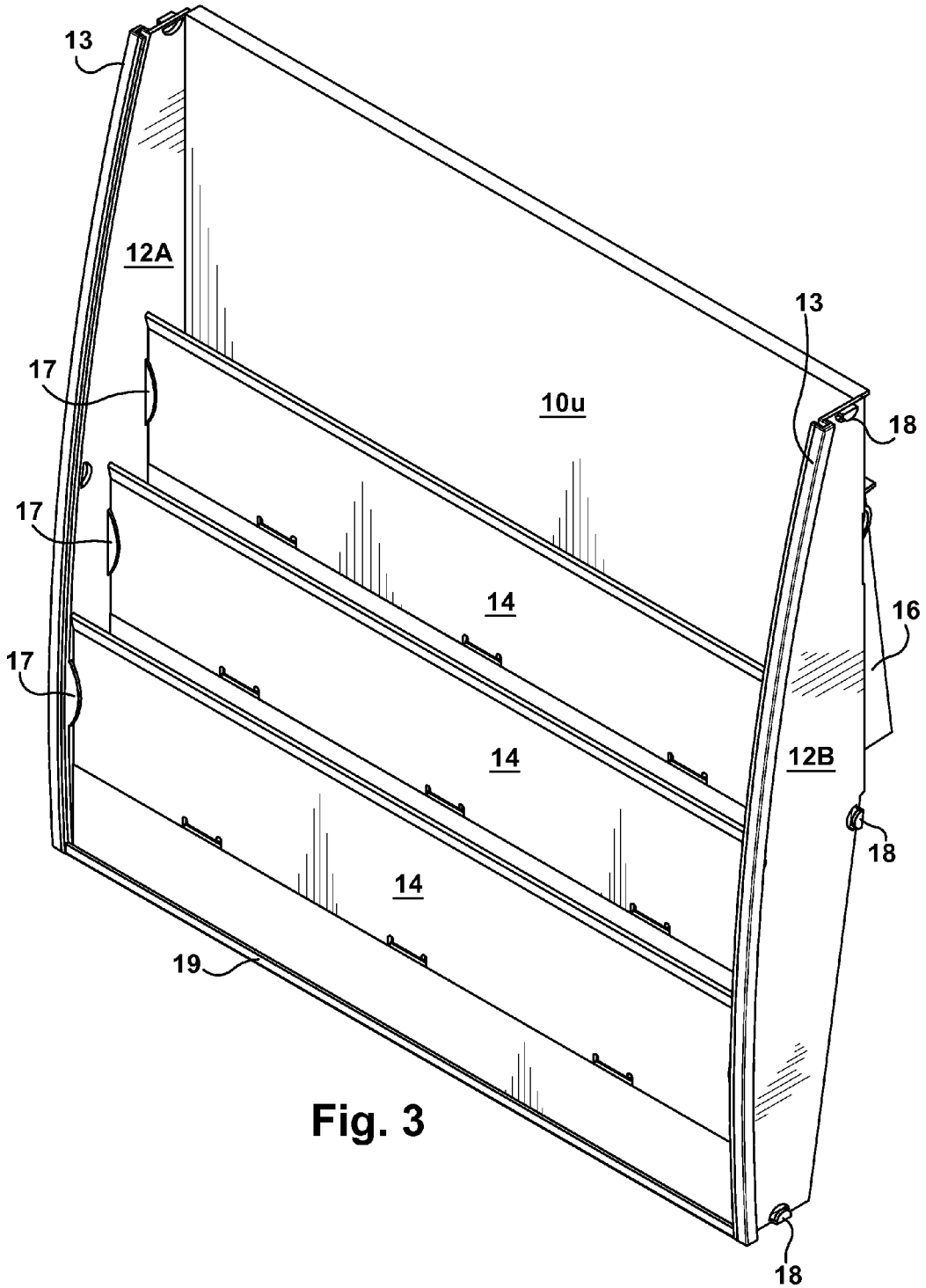
FIG. 3 is a front perspective view of the seasonal feature displayer of FIG. 1.
Figure 4:
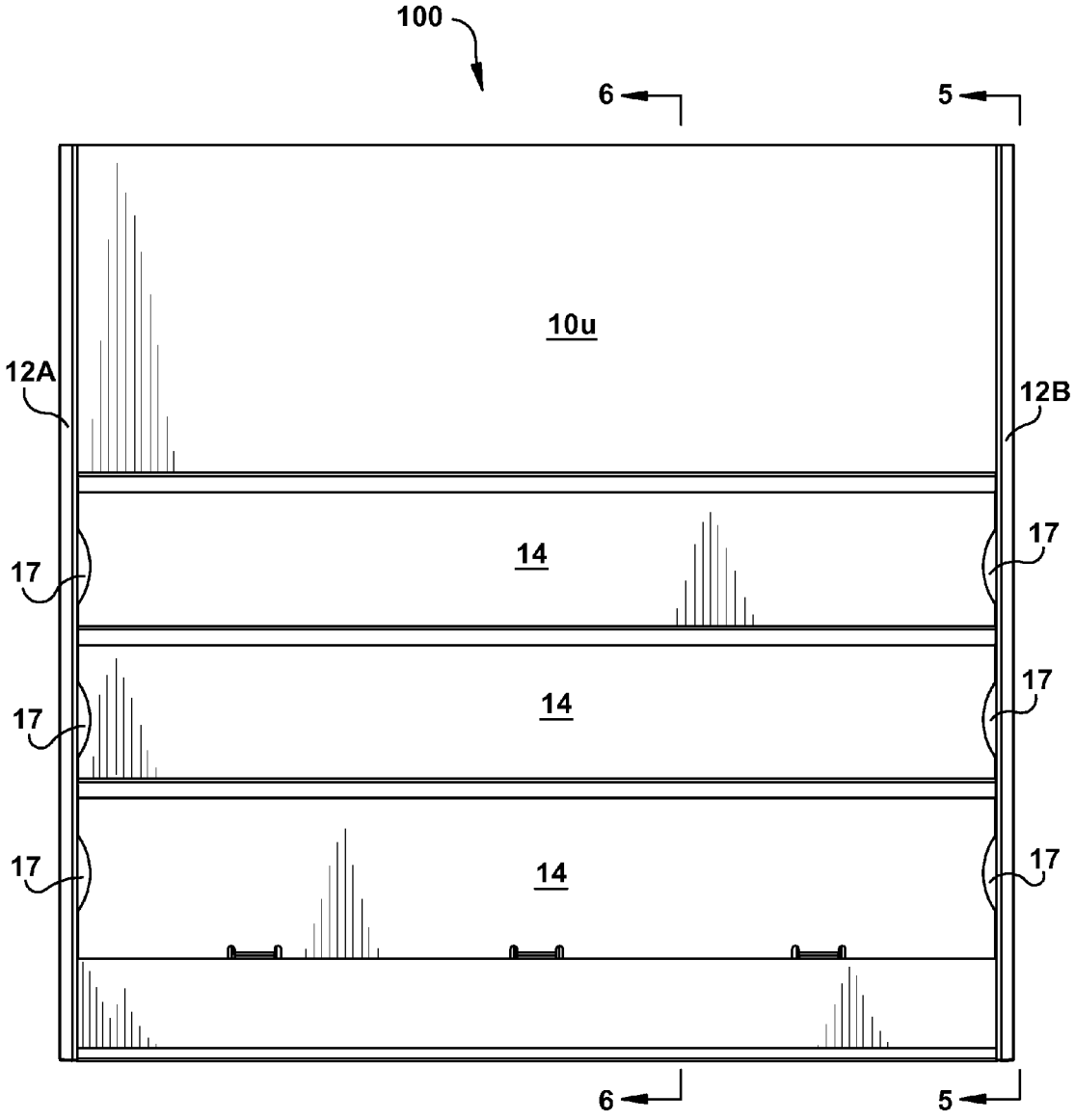
FIG. 4 is a front view of the seasonal feature displayer of FIG. 1.
Figure 5:
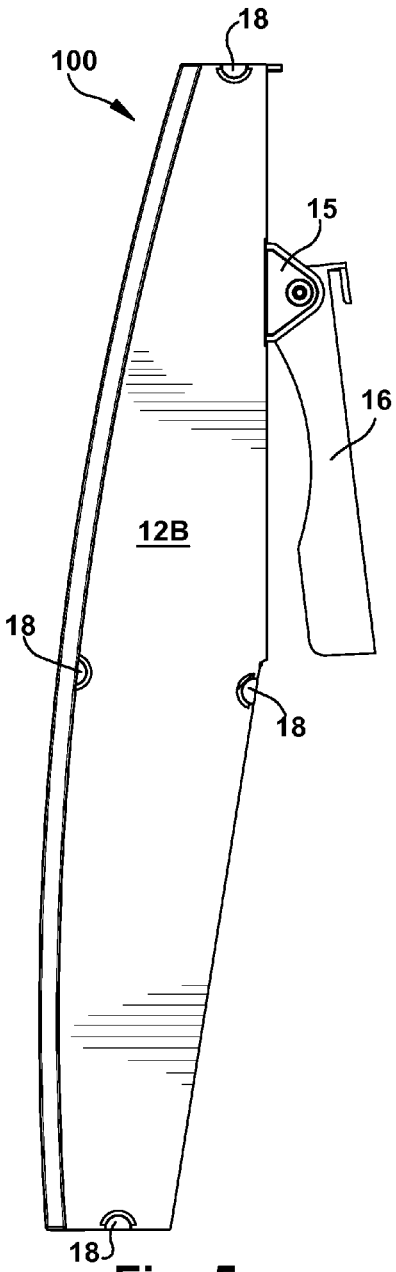
FIG. 5 is a side view of the seasonal feature displayer of FIG. 1.

The right 12A and left 12B side panels are attached to the right and left side edges of the tray 10, as shown in FIGS. 1 and 3. The right 12A and left 12B side panels operate to contain the greeting cards contained in each row within the displayer 100, to accommodate attachment and placement of the front pocket panels 14, to accommodate attachment of the tray hanger bracket 16, and to accommodate signage, graphic or other inserts. Each side panel 12A, 12B contains a back portion which generally corresponds in shape (upper planar portion and lower stepped portion) and length to the tray 10.

A curved or arcuate cap panel is attached to one side edge of the back portion of each side panel 12A, 12B (the curved cap panel of the right side panel 12A is attach to the right side edge of the back portion and the curved cap panel of the left side panel 12B is attached to the left side edge of the back portion). The front edge (curved or arcuate portion) of the each cap panel contains a narrow vertical channel 13 which may accommodate signage or graphics placement. These channels 13 may also support a frame insert which enables a fewer number of greeting cards to be highlighted and displayed upon the displayer without having empty space in the card pockets surrounding the greeting cards. On an inside surface of each cap panel are contained one or more spaced apart vertical channels 17 which are operative to receive one side edge of each front pocket panel 14. The channels 17 are spaced and elevated to correspond to each step or card row in the displayer 100. The right 12A and left 12B side panels also contain a small notch 15 which protrudes perpendicularly outward from the outer back surface of each panel 12A, 12B. The notch 15 contains a single opening or aperture contained thereon to facilitate attachment of the tray hanger bracket 16 between the right 12A and left 12B side panels.

As mentioned above, the tray 10 and right 12A and left 12B side panels work in combination with the front pocket panels 14 to create one or more card pockets (also referred to herein as rows or tiers). The front pocket panels 14, shown in FIGS. 1, 2, 3, 4 and 6, are substantially planar rectangularly shaped panels. The bottom edge of each front pocket panel contains one or more spaced apart, downwardly extending tabs, which correspond in width and location to each of the openings or apertures contained on each tier or step of the tray 10. To attach the front pocket panels 14 to the displayer, each side edge of each front pocket panel 14 is inserted into the narrow vertical channels 17 contained on the inside surface of the right 12A and left 12B side panels and the one or more spaced apart tabs are inserted into the one or more spaced apart opening located on the tray. The tray 10 serves as the back and the floor of each card pocket or row, the front pocket panel 14 serves as the front of each card pocket or row, and the right 12A and left 12B side panels serve as the left and right sides, respectively of each card pocket or row. In a preferred embodiment, the front pocket panel 14 is approximately 18-inches wide and 3.5-inches high (4-inches including tabs), although other dimensions have been contemplated and are considered to be within the scope of the invention.

A tray hanger bracket 16, shown in FIGS. 2, 5, 6 and 7, is attached to a back surface of the tray 10 between the right 12A and left 12B side panels and is used to attach the displayer 100 to the a tiered greeting card display fixture 20, as shown in FIG. 1. The hanger bracket 16 includes a horizontal component 21 which extends between two attachment support arms 22A, 22B located at opposite ends of the hanger bracket 16. The horizontal component 21 contains one or more downward facing channels 23 which extend from the top edge of the bracket 16 and are operative to fit over a card tier or card pocket contained on a greeting card display fixture 20, such as the one shown in FIG. 1. Each attachment support arm 22A, 22B is substantially rectangular with an inside edge having a concave arcuate portion which accommodates placement of the arms 22A, 22B within the tiers of a greeting card display fixture 20. The two attachment support arms 22A, 22B clip onto the displayer between the two tabs 15 located on the right 12A and left 12B side panels, and are operative to partially pivot about the attachment point in a backward or upward direction. The movement of the support arms 22A, 22B allows the displayer 100 to be more versatile and to adjust to varied card tier angles of differently configured greeting card display fixtures.

Attaching the seasonal feature displayer 100 to a traditional greeting card display fixture 20, as shown in FIG. 1, allows the greeting cards which are contained on the displayer 100 to be located at a distance closer to a consumer facing the fixture 20 than the greeting cards which are contained on the fixture 20. This configuration highlights or showcases the greeting cards located on the displayer 100 so that they may be easily locatable and especially noticeable to a consumer viewing the greeting cards on the fixture 20. The displayer 100 may be placed on any tier of a greeting card fixture at any location along the tier. More than one displayer 100 may be attached to a single fixture.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. A greeting card highlighter comprising:

a display comprising a backer panel having vertical upper portion which extends downward and outward into at least two stepped portions, each of the at least two stepped portions having a front pocket panel integral therewith forming a u-shaped channel into which a plurality of greeting cards may be inserted;

two side panels attached to opposing ends of the display;

a mounting bracket attached to the two side panels, the mounting bracket having two support arms which are partially pivotable about the two side panels, the mounting bracket only extending over the vertical upper portion of the backer panel;

wherein the two support arms of the mounting bracket are operative to be at least partially inserted into at least one greeting card tier of a larger greeting card display fixture.

2. The greeting card highlighter of claim 1, wherein the two support arms are operable to fit various sized card tiers.

3. The greeting card highlighter of claim 1 further comprising a narrow channel on a bottom front edge of the backer panel, wherein the signage or graphics may be inserted.

4. The greeting card highlighter of claim 1 further comprising a narrow channel along the length of each of the two side panels, wherein the signage or graphics may be inserted.

5. The greeting card highlighter of claim 1, wherein signage or graphics may be contained on either the backer panel or one or both of the two side panels.

6. The greeting card highlighter of claim 1, wherein the display is positioned in front of one or more of the plurality of card tiers on the main greeting card display.

7. The greeting card highlighter of claim 1, wherein the two support arms of the mounting bracket are partially inserted into one of the plurality of card tiers on the main greeting card display.

8. A combination greeting card fixture with attached highlighter comprising:

a main greeting card display having a plurality of tiered pockets for containing a plurality of greeting cards;

a four-piece highlighter having at least three tiered pockets for containing a plurality of greeting cards in both a stacked and a side-by-side arrangement;

a horizontal mounting bracket having two attachment arms extending downward from each opposing end of the horizontal mounting bracket that are pivotable about a portion of the highlighter, a free end of the two attachment arms being inserted into one of the plurality of tiered pockets of the main greeting card display;

wherein the highlighter contains two or more narrow channels; and wherein greeting cards contained on the highlighter are parallel to and spaced apart from greeting cards contained on the main greeting card display.

9. The greeting card highlighter of claim 8 further comprising a sign or decorative panel which is inserted into the two or more channels on the highlighter and is visible from the front of the highlighter.

10. The greeting card highlighter of claim 8 further comprising a sign or decorative panel which is inserted into the two or more channels on the highlighter and is visible from a side of the highlighter.

11. The greeting card highlighter of claim 8, wherein greeting card contained on the highlighter are located in front of greeting cards on the main greeting card display.

12. The greeting card highlighter of claim 8, wherein the highlighter is substantially smaller than the main greeting card display.

13. The greeting card highlighter of claim 8, wherein the mounting bracket may be adjusted to different insert angles.

* * * * *